US006668877B2

(12) United States Patent
Fehland et al.

(10) Patent No.: US 6,668,877 B2
(45) Date of Patent: Dec. 30, 2003

(54) FILLING SYSTEM FOR STILL BEVERAGES

(75) Inventors: Jorn Richard Fehland, Hamburg (DE); Jens H. Popplau, Hamburg (DE)

(73) Assignee: Alfill Engineering GmbH & Co KG, Hamburg (DE)

( * ) Notice: Subject to any disclaimer, the term of this patent is extended or adjusted under 35 U.S.C. 154(b) by 0 days.

(21) Appl. No.: 10/104,289

(22) Filed: Mar. 22, 2002

(65) Prior Publication Data

US 2002/0134457 A1 Sep. 26, 2002

(30) Foreign Application Priority Data

Mar. 24, 2001 (DE) ..... 101 14 660

(51) Int. Cl.[7] ..... B67C 3/26

(52) U.S. Cl. ..... 141/70; 141/47; 141/54; 141/63; 141/67; 141/85

(58) Field of Search ..... 141/4, 5, 11, 47–49, 141/54, 62–64, 67, 70, 85, 89

(56) References Cited

U.S. PATENT DOCUMENTS 2,787,875 A * 4/1957 Johnson ..... 53/284.5
5,313,990 A * 5/1994 Clusserath ..... 141/6
5,339,874 A * 8/1994 Cragun ..... 141/9
5,860,461 A * 1/1999 Helmut ..... 141/326

* cited by examiner

*Primary Examiner*—J. Casimer Jacyna
(74) *Attorney, Agent, or Firm*—Rankin, Hill, Porter & Clark LLP

(57) ABSTRACT

A filling system having a discharge unit to fill still beverages under an open ambience into containers. The filling system has an annular nozzle from which blows a sterile gas in the direction of filling. The nozzle is mounted on the filling system concentrically with the discharge unit such that sterile gas encircles beverages being discharged from the discharge unit.

6 Claims, 1 Drawing Sheet

FILLING SYSTEM FOR STILL BEVERAGES

BACKGROUND OF THE INVENTION

Stationary beverage container filling systems usually are used in the generic configuration, that is open, without sealing the discharge unit relative to the container rim.

Because the filling system's discharge unit is not sealed relative to the container, there is a risk that the beverage will be contaminated with oxygen and germs. In the case of rigorous hygienic requirements, which require a total absence of oxygen and germs, the filling procedure must be carried out in a sealed manner and, thus, the apparatus must also be more complex.

SUMMARY OF THE INVENTION

An object of the present invention is to create a filling system that meets high requirements of absence of oxygen and of high sterility while filling in open state.

In accordance with the present invention, the filling system includes an annular nozzle from which issues an annular or sleeve-shaped gaseous curtain in the direction of, and concentrically with, the beverage filling stream. The gaseous curtain encloses the discharge unit and its edge, that is, as regards bottles, their neck, and it seals the inside of the curtain against externally penetrating gas and hence against the entrainment of oxygen and germs. A convention sterile and oxygen-free gas such as nitrogen or $CO_2$ may be used.

In further accordance with the present invention, a source of sterilizing radiation preferably configured annularly around the filling system irradiates the container rim or the neck zones, respectively. Furthermore, the surrounding area may also be subjected to sterilizing radiation to additionally assure freedom from germs in this region. The radiation source may be operated in a pulsed or continuous manner and it will emit a suitable sterilizing radiation, such as gamma radiation. An annular fluorescent lamp emitting uv is especially well suited for the present purpose.

In further accordance with the present invention, a gas-jet nozzle, which is preferable directed into the container orifice, blows sterile gas into the container before filling starts. Such sterile gas rinses the container so that any germs and oxygen present therein are removed. In this manner, sterility and freedom from oxygen during filling are further improved. The gas issuing from the container is removed by the gas curtain. Any germs contained in the gas exiting from the container will be killed by the sterilizing radiation.

BRIEF DESCRIPTION OF THE DRAWING

These and further features of the invention will be apparent with reference to the following description and drawing, which schematically shows a partly sectional sideview of a filling system of the invention during bottle filling, above a bottle.

DETAILED DESCRIPTION OF THE PREFERRED EMBODIMENTS

Figure 1:
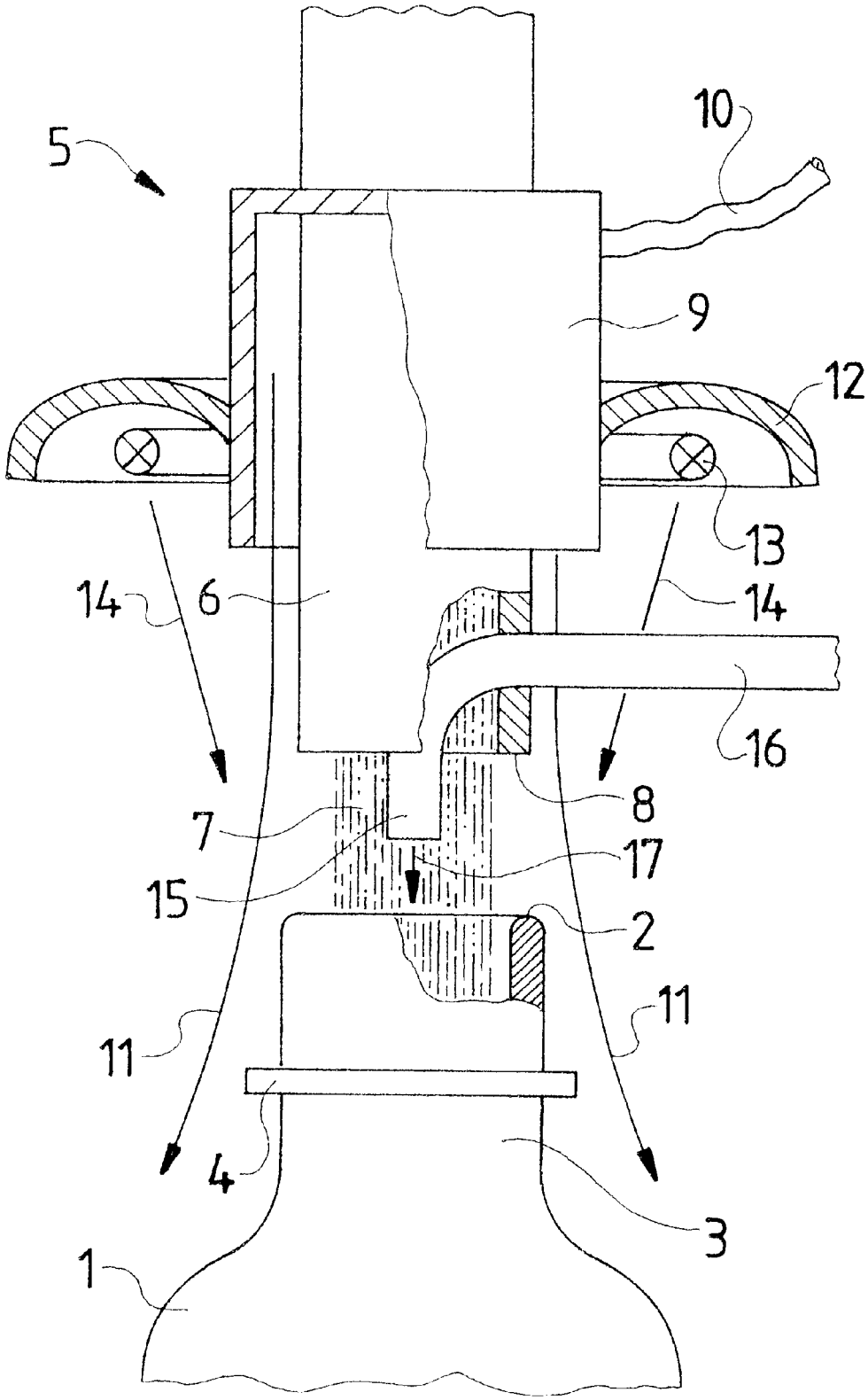

The container to be filled is shown as a modern beverage bottle 1 made of PET or another material and is fitted below the rim 2 of its mouth at the neck 3 with the conventional neck collar 4. By means of elements not shown, for instance a bracket gripping below the collar 4, the bottle 1 is kept in the shown position.

A filling system 5 is configured above the bottle and comprises a discharge unit 6, here shown in simplified manner as a tube, from which the beverage 7, as shown, is filled into the bottle 1 as shown.

In this procedure, the lower rim 8 of the discharge unit 6 is spaced a distance above the rim 2 of the bottle 1. Accordingly, filling takes place under the open ambience. Such a filling mode is known in the art, and is conventional with still beverage container that filled in unpressurized conditions.

An annular nozzle 9 is mounted around the discharge unit 6 and directs a downward stream of gas, which is fed to it from a sterile gas source (not shown) through a feed line 10, by means of an annular nozzle orifice directed parallel to the discharge unit 6. The gas is expelled downwardly in the direction of the arrows 11 and, in this manner, constitutes a sleeve-like cross-sectionally circular gas curtain enclosing the discharge unit 6 and the neck 3 of the bottle 1.

In this manner the space in the vicinity of the rim 2 of the bottle 1 and between the bottle and the discharge unit 6 is protected against entry of oxygen and germs present in the ambience. Illustratively, nitrogen or $CO_2$ may be used as the sterile gas. A valve (not shown) in the feed line 10 may be actuated to assure that the curtain of sterile gas shall be ON only during filling.

At the filling system 5, shown in this embodiment being mounted on the annular nozzle 9, a circular fluorescent lamp is provided to generate uv light. The lamp includes an annular reflector 12 and an annular tube 13. This annular lamp radiates downwardly in the direction of the arrows 14 onto the region of the neck 3 and the rim 2 of the bottle 1 and, in this manner, the light's uv irradiation assures further improvement in sterility in this region.

The filling system 5 moreover is fitted with a jet nozzle 15, which in the illustrated and preferred embodiment is mounted inside the discharge unit 6 and is connected to the outside by a supply line 16. The jet nozzle 15 also is supplied with pressurized, sterile gas, which gas-jet nozzle in turn blows in the direction of the arrow 17 into the orifice of the bottle 1. Valves (not shown) drive the jet nozzle 15 such that it blows sterile gas into the bottle 1 before filling begins in order to lower the oxygen content in the bottle and to flush out any germs the bottle may contain. In another embodiment, this jet nozzle 15 also may be mounted next to the discharge unit 6 while pointing at the orifice of the bottle 1.

What is claimed is:

1. A filling system (5) for filling a beverage (7) into an open container (1) in an open ambient environment, said filling system comprising:

(a.) a discharge unit (6) through which the beverage (7) may be discharged, said discharge unit having a lower end spaced upwardly from an opening of the container (1) when the container (1) is being filled with the beverage (7); and (b.) a nozzle (9) having a lower end disposed above the lower end of the discharge unit (6) and through which sterile gas may be blown in a direction of filling, said nozzle being mounted radially outward from and concentrically with the discharge unit (6) so as to define an annular orifice therebetween; and wherein the positioning and configuration of the lower end of the nozzle and the lower end of the discharge unit are such that when sterile gas is blown through the annular orifice, the sterile gas forms a cylindrical curtain that extends around the lower end of the discharge unit, around the space between the lower end of the discharge unit (6) and the opening of the container (1) and around a top portion of the container, thereby preventing contaminants from the open ambient environment from entering the container.

2. The filling system as claimed in claim 1, further comprising a sterilizing source of radiation (12, 13) operable to irradiate an upper portion of the container, said sterilizing source of radiation being disposed above the lower end of the nozzle.

3. The filling system as claimed in claim 2, wherein the sterilizing source of radiation comprises an annular fluorescent lamp disposed around the nozzle.

4. The filling system as claimed in claim 1, further comprising a jet nozzle (15) for blowing a sterile gas in the direction of filling, said jet nozzle having a lower end disposed below the lower end of the discharge unit.

5. The filling system as claimed in claim 4, wherein the lower end of the jet nozzle is disposed coaxially with the lower end of the discharge unit.

6. The filling system as claimed in claim 5, wherein the jet nozzle blows the sterile gas into the container (1) before the beverage (7) is dispensed into the container in order to lower the oxygen content in the container (1) and to flush out contaminants in the container.

* * * * *

UNITED STATES PATENT AND TRADEMARK OFFICE

CERTIFICATE OF CORRECTION

PATENT NO. : 6,668,877 B2
DATED : December 30, 2003
INVENTOR(S) : Fehland et al.

It is certified that error appears in the above-identified patent and that said Letters Patent is hereby corrected as shown below:

Column 4,
Line 11, after "out" insert -- any --.

Signed and Sealed this

Sixteenth Day of March, 2004

JON W. DUDAS
*Acting Director of the United States Patent and Trademark Office*